US009709063B2

(12) United States Patent
Tsai et al.

(10) Patent No.: US 9,709,063 B2
(45) Date of Patent: Jul. 18, 2017

(54) FAN STRUCTURE WITH WEAR RESISTANT FILM COATED SHAFT LINER

(71) Applicant: COOLER MASTER CO., LTD., New Taipei (TW)

(72) Inventors: Shui-fa Tsai, New Taipei (TW); Shih-wei Huang, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 169 days.

(21) Appl. No.: 14/536,910

(22) Filed: Nov. 10, 2014

(65) Prior Publication Data

US 2015/0159667 A1 Jun. 11, 2015

(30) Foreign Application Priority Data

Dec. 5, 2013 (TW) ..... 102222915 U

(51) Int. Cl.

| | |
|---|---|
| ***F04D 25/06*** | (2006.01) |
| ***F04D 25/08*** | (2006.01) |
| ***F04D 29/056*** | (2006.01) |
| ***F04D 29/057*** | (2006.01) |
| ***F04D 17/16*** | (2006.01) |
| ***F04D 29/02*** | (2006.01) |

(52) U.S. Cl.

CPC ..... *F04D 17/16* (2013.01); *F04D 25/062* (2013.01); *F04D 29/023* (2013.01); *F04D 29/057* (2013.01); *F05D 2300/611* (2013.01)

(58) Field of Classification Search

CPC ..... F04D 25/062; F04D 29/057; F04D 29/056

USPC ..... 417/354, 420, 423.12

See application file for complete search history.

(56) References Cited

U.S. PATENT DOCUMENTS

| | | | | |
|---|---|---|---|---|
| 6,290,471 | B1 * | 9/2001 | Horng | F04D 29/023 417/354 |
| 6,893,230 | B2 * | 5/2005 | Sung | F04D 29/057 416/174 |
| 8,052,328 | B2 * | 11/2011 | Hibi | F16C 17/02 384/107 |
| 8,328,533 | B2 * | 12/2012 | Yu | F04D 25/0613 310/67 R |
| 8,690,552 | B2 * | 4/2014 | Chang | F04D 17/16 415/205 |
| 2002/0172438 | A1 * | 11/2002 | Nakagawa | F16C 17/02 384/107 |
| 2006/0192450 | A1 * | 8/2006 | Hsieh | F04D 29/0563 310/90 |

(Continued)

*Primary Examiner* — Peter J Bertheaud

(74) *Attorney, Agent, or Firm* — Muncy, Geissler, Olds & Lowe, P.C.

(57) ABSTRACT

A fan structure with a wear resistant film coated shaft liner includes a stator, a fan blade and a fan shield. The stator includes an axle center at a center portion thereof. The fan blade comprises a blade wheel, a shaft liner arranged at a center of the blade wheel and extended axially therefrom, a plurality of blades arranged to circumference the blade wheel externally and a magnetic unit arranged on the blade wheel. The fan shield covers the fan blade externally and includes a fixation portion for securing the axle center. The shaft liner of the fan blade includes an axial hole in order to allow the axle center of the stator to pivotally attach thereto. The axial hole is of a blind hole shape, and an inner wall surface of the axial hole is coated with a wear resistant film in contact with the axle center.

9 Claims, 3 Drawing Sheets

(56) References Cited

U.S. PATENT DOCUMENTS

2012/0121389 A1* 5/2012 Chang ..... F04D 17/16
415/122.1

* cited by examiner

FAN STRUCTURE WITH WEAR RESISTANT FILM COATED SHAFT LINER

BACKGROUND OF THE INVENTION

Field of the Invention

The present invention is related to a fan, in particular, to a fan structure with a wear resistant film coated shaft liner.

Description of Related Art

As the computer industry advances rapidly nowadays, fans have become one of the essential components for heat dissipation in computers. In addition, the fans are required not only to satisfy the needs for heat dissipation but also to be able to cope with the light and slim designs of the computer or 3C products nowadays such that they are confined by the physical space and volume available in addition to that the weights need to be taken into consideration for the light-weight designs of the fans.

A traditional heat dissipating fan with an inverted axle center is typically provided with a wear plate disposed at the contact area between the axle center end portion and the bearing in order to lessen the problem of wears occurred between the bearing sleeve and the axle center. However, after taking into the account of the slim design of the fan, since the sizes of the related components are much smaller, the assembly operation of the fan becomes relatively difficult. Furthermore, since the wear plate still has a certain thickness, there is still a problem associated with the increase of the overall thickness of the fan once the wear plate is stacked onto the axle center end portion, which is not optimal and needs to be improved.

In view of the above, the inventor seeks to overcome the problems associated with the currently existing technique after years of research and development along with the utilization of theoretical principles, and it is an objective of the inventor to provide a reasonable design and an improvement capable of effectively solve the aforementioned problems.

SUMMARY OF THE INVENTION

A primary objective of the present invention is to provide a fan structure with a wear resistant film coated shaft liner. It includes an axial hole of a blind hole shape formed on a shaft liner provided to allow an axle center of the fan to be pivotally attached thereto such that a wear resistant film is coated onto an inner wall of the axial hole; therefore, with the thin thickness of the coated film, the overall thickness of the fan can reduced while a greater performance for wear resistance can achieved. As a result, the present invention is applicable to be utilized in a light and slim fan structure.

To achieve the aforementioned objective, the present invention provides a fan structure with a wear resistant film coated shaft liner comprising a stator, a fan blade and a fan shield. The stator includes an axle center at a center portion thereof; the fan blade comprises a blade wheel, a shaft liner arranged at a center of the blade wheel and extended axially therefrom, a plurality of blades arranged to circumference the blade wheel externally and a magnetic unit arranged on the blade wheel; the fan shield covers the fan blade externally, and the fan shield includes a fixation portion formed therein in order to secure the axle center; wherein the shaft liner of the fan blade includes an axial hole formed therein and provided to allow the axle center of the stator to be pivotally attached thereto; the axial hole is of a blind hole shape; and an inner wall surface of the axial hole is coated with a wear resistant film in contact with the axle center.

Therefore, with the utilization of the wear resistant film coating, the present invention is able to achieve the aforementioned objective.

DETAILED DESCRIPTION OF THE INVENTION

To further disclose the features and technical content of the present invention, the fowling provides a detailed description of the present invention along with the accompanied drawings. However, it shall be understood that the description and the accompanied drawings are provided for illustration purposes only, which shall not be treated as limitations of the present invention.

Figure 1:
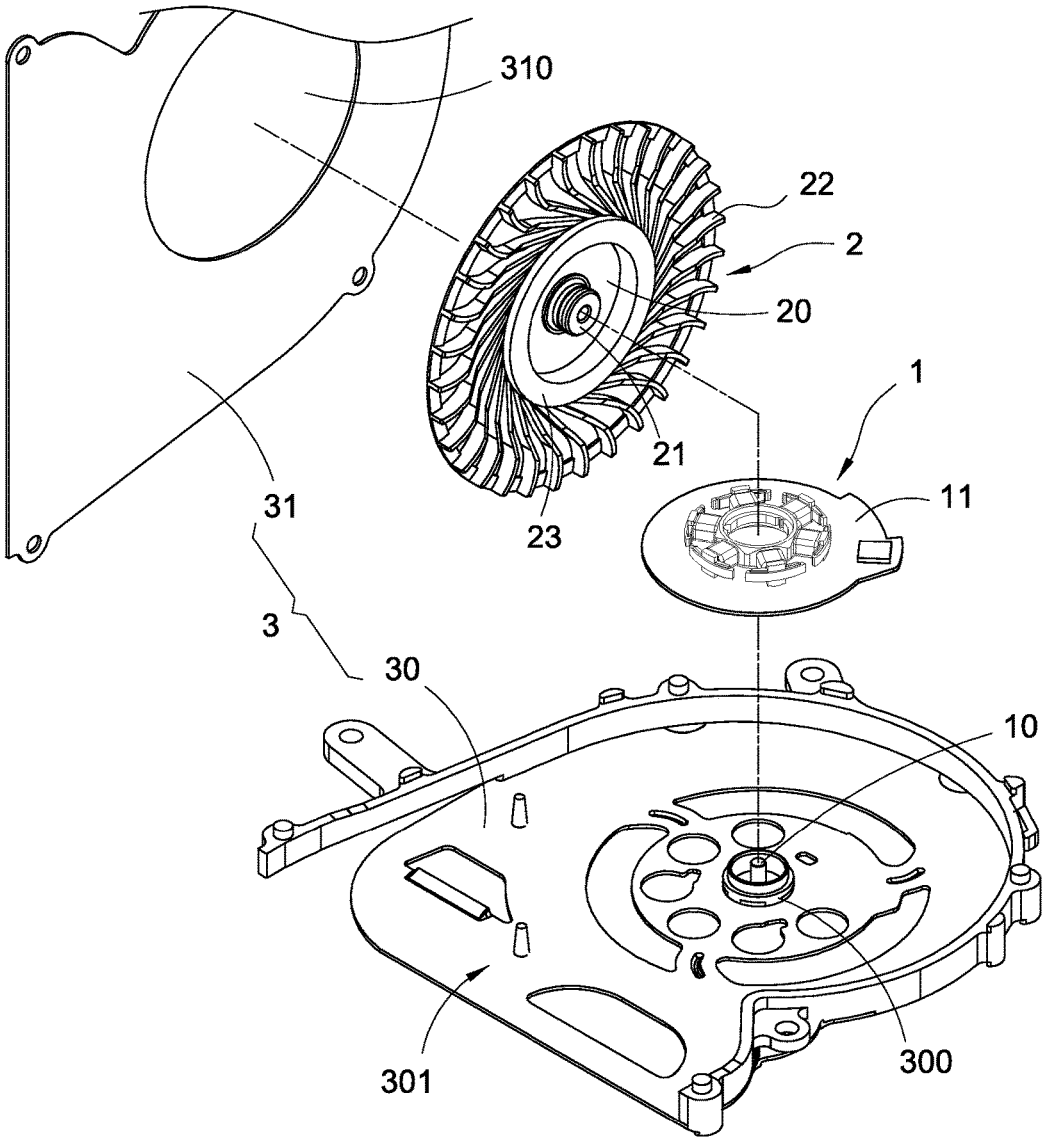
FIG. 1 is a perspective exploded view of the present invention.

Please refer to FIG. 1, showing a perspective exploded view of the present invention. The present invention provides a fan structure with a wear resistant film coated shaft liner comprising a stator 1, a fan blade 2 and a fan shield 3.

Figure 2:
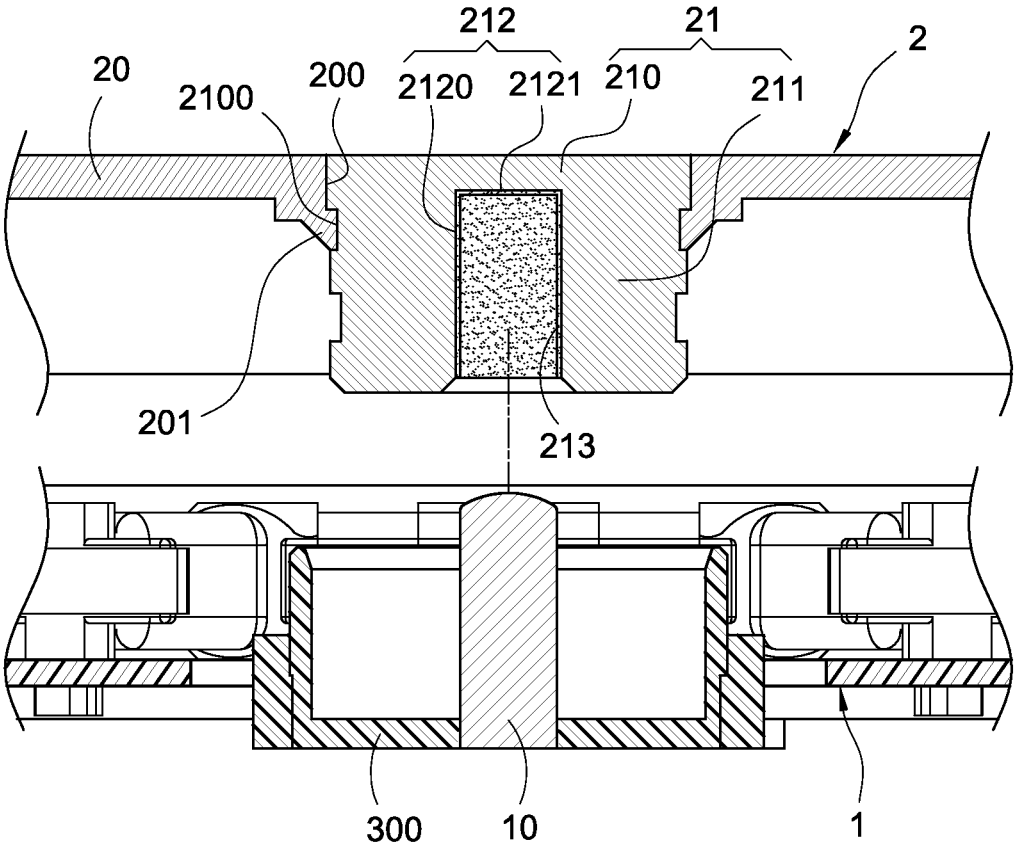
FIG. 2 is an exploded view showing a partial cross section of the stator and the fan blade of the present invention.
Figure 3:
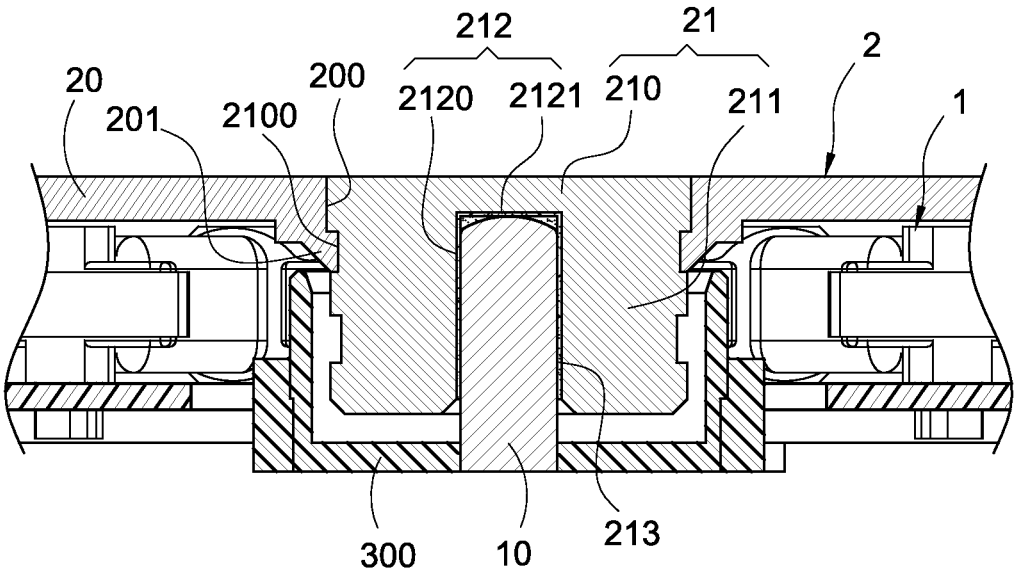
FIG. 3 is an assembly view showing a partial cross section of the stator and the fan blade of the present invention.

The stator 1 is a motor of the fan and can be constructed by a silicon steel plated with a coil of wire wound thereon. In addition, the stator 1 includes an axle center 10 at a center portion thereof, as shown in FIG. 2 or FIG. 3. The axle center 10 can be pivotally attached to the aforementioned fan blade 2, and the stator 1 further includes a circuit board 11 for controlling the electrical conductance of the stator 1 in order to generate an electromagnetic effect for driving the fan blade 2 to rotate.

As shown in FIG. 2, the fan blade 2 comprises a blade wheel 20, a shaft liner 21 arranged at a center of the blade wheel 20 and extended axially therefrom, a plurality of blades 22 arranged to circumference the blade wheel 20 externally and a magnetic unit 23 arranged on the blade wheel 20. In addition, the shaft liner 21 is pivotally attached to the axle center 10 of the stator 1, as shown in FIG. 3. According to an embodiment of the present invention, the center of the blade wheel 20 further includes a fixation hole 200 formed thereon; and the shaft liner 21 includes a fixation edge 210 inserted into the fixation hole 200 and is constructed by a sleeve shaft portion 211 arranged underneath the fixation edge 210 and formed to circumference the fixation edge 210 In addition, an outer side of the fixation edge 210 further includes an insertion slot 2100 formed to indent inward thereon, and an inner edge of the fixation hole 200 includes an insertion block 201 formed thereon and configured to cooperate with the insertion slot 2100 correspondingly in order to allow the shaft liner 21 to be inserted into the blade wheel 20 of the fan blade 2 with greater stability.

As shown in FIG. 1 again, the fan shield 3 covers the fan blade 2 externally and comprises a base 30 and a shield cover 31. The base 30 includes a fixation portion 300 provided to allow the stator 1 to be secured thereon as well as to further allow the axle center 10 to be positioned therein in order to be vertically secured onto the base 30. In addition, one side of the base 30 includes a first air opening 301; the shield cover 31 covers onto the base 30 and includes a second air opening 310 opposite from the fan blade 2. The first and second air openings 301, 310 are an air inlet and an air outlet respectively, which can also be configured according to the actual direction of rotation of fan blade 2.

Please refer to FIG. 2 and FIG. 3. In the present invention, the sleeve shaft portion 211 of the shaft liner 21 is formed to circumference a lower portion of the fixation edge 210, following which the axial hole 212 is further formed inside the shaft liner 21 in order to allow the axle center 10 of the stator 1 to be pivotally attached thereto. The axial hole 212 penetrates through the sleeve shaft portion 211 from a bottom thereof in order to form a blind hole shape; and the sleeve shaft portion 211 includes an inner circumferential surface 2120 and an inner top surface 2121 formed thereon. In addition, the wear resistant film 213 is coated onto the inner wall surfaces of the axial hole 212 including the inner circumferential surface 2120 and the inner top surface 2121. The wear resistant film 213 can be made of a diamond material coated film such that it is able to provide an excellent wear resistant property for the shaft liner 21 pivotally attached to the axle center 10 in order to reduce the coefficient of friction between the two parts and to further increase the useful lifetime of the axle center 10 and the shaft liner 21 of the fan.

Figure 4:
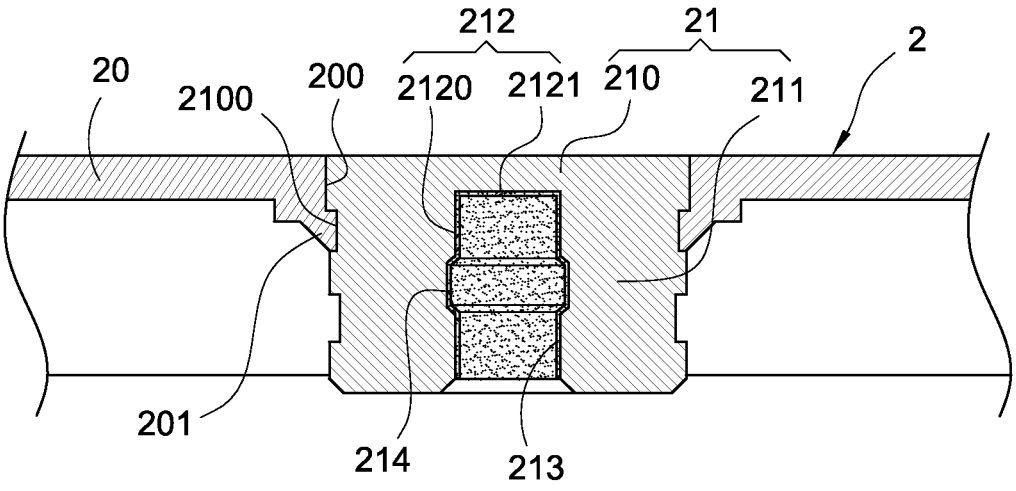
FIG. 4 is an illustration showing a partial cross section according to another embodiment of the fan blade of the present invention.

Furthermore, as shown in FIG. 4, according to another embodiment of the present invention, the shaft liner 21 of the fan blade 2 can further include a refraction slot 214 formed on the inner circumferential surface 2120 of the axial hole 212 and indented inward radially in order to reduce the friction area between the shaft liner 21 and the axle center 10. In addition, since the inner wall surface of the retraction slot 214 is not in contact with the axle center 10, there is no need to coat the wear resistant film 213 onto the inner wall surface of the retraction slot 214. However, to facilitate the manufacturing process, the inner wall surface of the retraction slot 214 can still be coated with the wear resistant film 213 during the coating process of the wear resistant film onto the inner wall of the axial hole 212.

According to the above, a fan structure with a wear resistant film coated shaft liner of the present invention can be obtained from the aforementioned structure and assembly.

In view of the above, the fan structure with a wear resistant film coated shaft liner of the present invention has at least the following merits:

1. Since the axial hole 10 is a blind hole and the inner wall of the axial hole is coated with the wear resistant film, an excellent wear resistant property can be achieved between the axle center and the shaft liner 21 in order to reduce the coefficient of friction therebetween such that the useful lifetime of the fan is increased.

2. By coating the wear resistant film 213 onto the inner wall of the axial hole, the coating process is relatively simple for manufacturing in practice such that there is no problem associated with the assembly of tiny components or components with small sizes; in addition, the thickness of the coated film is relatively thinner such that it is excellent for the application on fans having slim and light structures.

3. With the use of the coating of the wear resistant film 213, less component parts are required and without any concerns on the assembly tolerances; therefore, it is able to not only avoid the addition of components to the assembly, which can cause the overall thickness to increase as the wear plate in the known arts, but also overcome the problem associated with the tolerances during the assembly of the components. As a result, the situation where the stability between the axle center 10 and the shaft liner 21 pivotally attached thereto being affected due to errors in the assembly tolerance during the assembly thereof can be prevented.

In view of the above, the present invention is novel and unique in its kind while being able to achieve the objectives expected and to overcome the drawbacks of the prior arts effectively. The present invention satisfies the requirement for patentability and is applied legitimately for the grant of the right of patent.

The above provides descriptions on the preferred embodiment of the present invention only, which shall not be treated as limitations of the present invention. Any equivalent modifications without deviating from the spirit of the present invention shall be deemed to be within the scope of the present invention.

What is claimed is:

1. A fan structure with a wear resistant film coated shaft liner comprising:

a stator having an axle at a center portion thereof;

a fan blade comprising a blade wheel, a shaft liner arranged at a center of the blade wheel and extended axially therefrom, a plurality of blades protruding from the blade wheel about its circumference, and a magnetic unit arranged on the blade wheel; and a fan shield covering the fan blade externally; the fan shield having a fixation portion formed therein in order to secure the axle;

wherein the shaft liner of the fan blade includes an axial hole formed therein and provided to allow the axle of the stator to be pivotally attached thereto; the axial hole is of a blind hole shape; an inner wall surface of the axial hole includes an inner circumferential surface and an inner top surface which are coated with a wear resistant film being in contact with the axle, such that by coating the wear resistant film onto the inner wall surface of the axial hole, there are no problems associated with the assembly of tiny components or components with small sizes, and a thickness of the wear resistant film is thinner for an application on fans having a slim and light structure, and wherein the inner circumferential surface is formed with a retraction slot recessed within the shaft liner and located in a middle of the axial hole for reducing contacting areas with the axle, and the retraction slot is also coated with the wear resistant film.

2. The fan structure with a wear resistant film coated shaft liner according to claim 1, wherein the center of the blade wheel of the fan blade includes a fixation hole formed thereon; and the shaft liner includes a fixation edge inserted into the fixation hole and is constructed by a circle-shaped sleeve shaft portion downwardly protruded from the fixation edge to form the axial hole.

3. The fan structure with a wear resistant film coated shaft liner according to claim 2, wherein the axial hole penetrates through the sleeve shaft portion from a bottom thereof in order to form the blind hole shape.

4. The fan structure with a wear resistant film coated shaft liner according to claim 2, wherein an outer side of the fixation edge includes an insertion slot formed to indent inward thereon, and an inner edge of the fixation hole includes an insertion block formed thereon and configured to cooperate with the insertion slot correspondingly.

5. The fan structure with a wear resistant film coated shaft liner according to claim 1, wherein the wear resistant film is made of a diamond material coated film.

6. The fan structure with a wear resistant film coated shaft liner according to claim 5, wherein the stator is constructed by a silicon steel plate with a coil of wire wound thereon.

7. The fan structure with a wear resistant film coated shaft liner according to claim 6, wherein the stator further includes a circuit board.

8. The fan structure with a wear resistant film coated shaft liner according to claim 5, wherein the fan shield comprises a base and a shield cover; the fixation portion is arranged on the base, and one side of the base includes a first air opening; the shield cover covers onto the base and includes a second air opening opposite from the fan blade.

9. The fan structure with a wear resistant film coated shaft liner according to claim 8, wherein the first and second air openings are an air inlet and an air outlet respectively.

* * * * *